United States Patent [19]

Lehrman

[11] Patent Number: 4,484,400

[45] Date of Patent: Nov. 27, 1984

[54] COPPER-METALLIZED FABRIC FOR AN IRONING BOARD COVER

[75] Inventor: David Lehrman, Cheltenham, Pa.

[73] Assignee: The Ironees Company, Philadelphia, Pa.

[21] Appl. No.: 563,537

[22] Filed: Dec. 20, 1983

Related U.S. Application Data

[63] Continuation of Ser. No. 369,863, Apr. 19, 1982, abandoned.

[51] Int. Cl.[3] ..... D06F 83/00

[52] U.S. Cl. ..... 38/140; 428/263; 428/328

[58] Field of Search ..... 38/140, 66, 68; 428/71, 428/263, 289, 319.1, 328, 138, 245, 253, 254; 106/1.13, 1.18, 193 M

[56] References Cited

U.S. PATENT DOCUMENTS

| | | | |
|---|---|---|---|
| 2,600,913 | 6/1952 | Olson | 38/140 X |
| 2,726,977 | 12/1955 | See et al. | 428/138 |
| 2,954,552 | 9/1960 | Halpern | 428/328 X |
| 3,049,826 | 8/1962 | Goldsmith | 38/140 |
| 3,148,467 | 9/1964 | Kerr | 38/140 |
| 3,414,995 | 12/1968 | Adiletta et al. | 38/140 |
| 3,691,661 | 9/1972 | Steinbronn | 38/140 |
| 3,733,724 | 5/1973 | Davis | 38/140 |
| 3,911,603 | 10/1975 | Lehrman | 38/140 |
| 4,032,681 | 6/1977 | Jonnes | 428/263 X |
| 4,043,062 | 8/1977 | Lehrman | 38/140 |
| 4,116,710 | 9/1978 | Heikel | 106/193 M X |
| 4,166,146 | 8/1979 | Koos | 428/328 X |
| 4,360,984 | 11/1982 | Ruttenberg | 38/140 |
| 4,416,940 | 11/1983 | Loye et al. | 428/328 X |

FOREIGN PATENT DOCUMENTS

| | | | |
|---|---|---|---|
| 45-27134 | 5/1970 | Japan | 106/1.13 |

*Primary Examiner*—Werner H. Schroeder
*Assistant Examiner*—Andrew M. Falik
*Attorney, Agent, or Firm*—Seidel, Gonda & Goldhammer

[57] ABSTRACT

A fabric which is coated on at least its upper exposed surface with a heat-reflective and heat-retentive metallic coating containing from about 85% to about 99% copper. The copper is coated with a non-metallic material such as a silicate or silicon oxide. The fabric of the invention is particularly useful in covers for ironing boards, pressing machines and the like, but is useful in any application which calls for a heat-reflective, heat-retentive, flexible, porous metallized fabric.

15 Claims, 3 Drawing Figures

FIG. 1
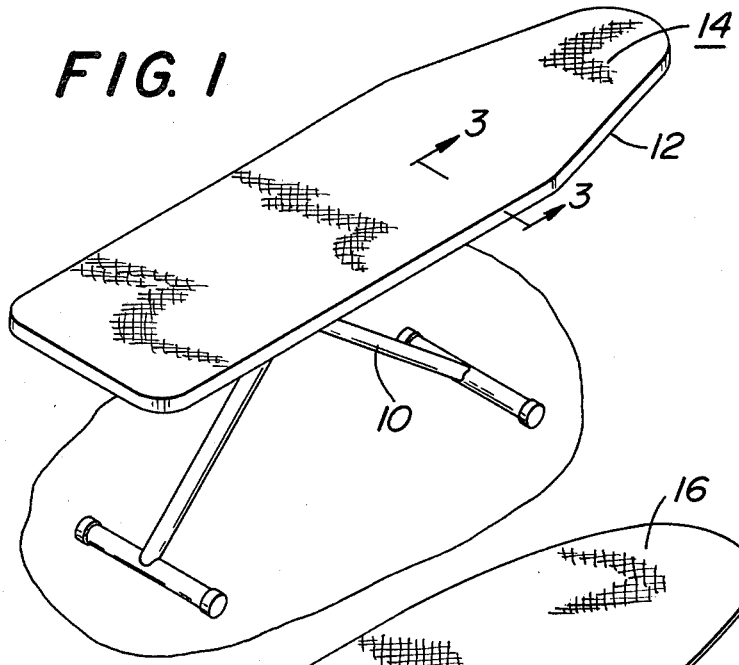
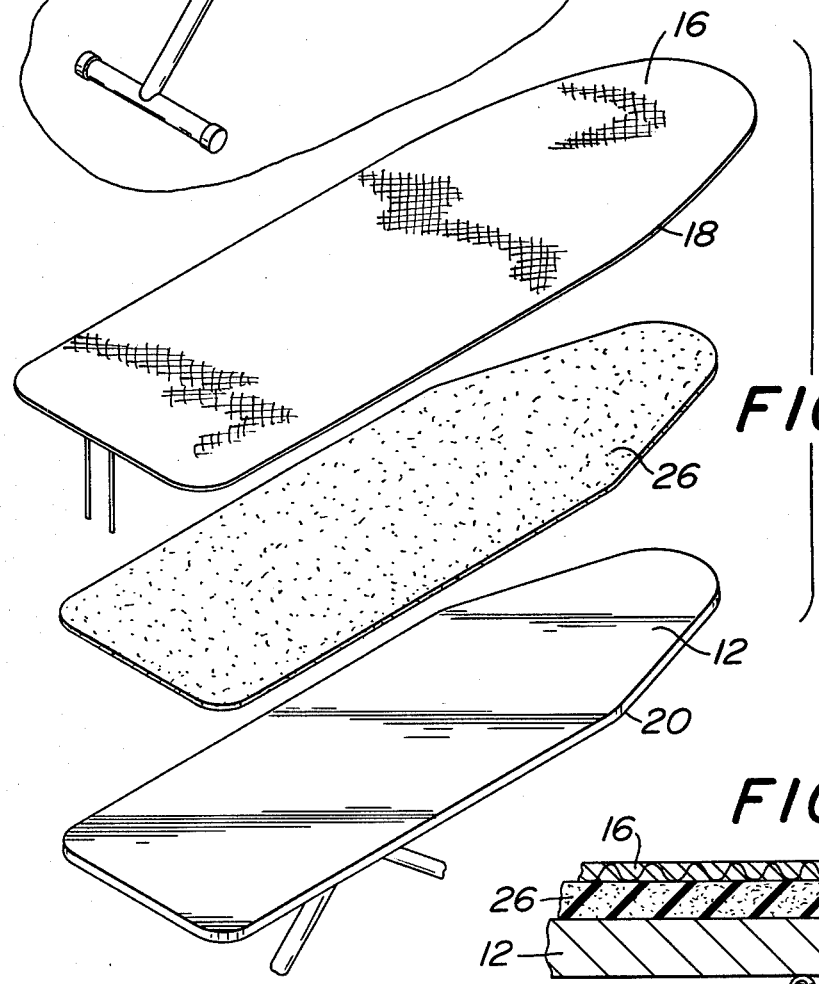
FIG. 2
FIG. 3
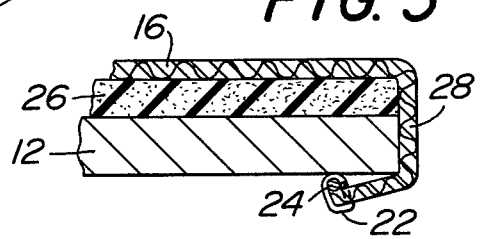

COPPER-METALLIZED FABRIC FOR AN IRONING BOARD COVER

This application is a continuation of application Ser. No. 369,863, filed Apr. 19, 1982, now abandoned.

BACKGROUND OF THE INVENTION

This invention relates to metallized fabrics, particularly for use in ironing board covers and the like which are copper coated and therefore highly heat retentive and heat reflective, as well as highly scorch resistant.

Traditionally, ironing board covers have been made of natural loom-state greige cotton fabric. In later years, this fabric was either bleached white, dyed or screen printed. This later evolved into fabric with a superimposed coating in the form of a continuous metal film overlying the fabric surface. Such coatings include pure aluminum flakes, teflon or silicone, and other materials dispersed in acrylic resin binders.

Metallized ironing board covers are described in U.S. Pat. Nos. 2,600,913 and 3,049,826. In each case, the metallized layer overlying the upper surface of the cover fabric is in the form of a continuous film, which is integral, non-porous and smooth. In each case, the surface characteristics of the ironing board cover are those of the metal film.

Metallized fabrics are also known and are described, for example, in U.S. Pat. No. 4,032,681. This patent describes a reflective fabric comprising a base fabric covered with a metal film bonded to the fabric. The metal film is fractured to provide openings in the film to let the fabric "breathe", but the surface characteristics of the finished product are still those of the metal film.

Known metallized ironing board covers and other metallized fabrics often use aluminum as the metal. This is yet another drawback to known metallized fabrics because, in producing aluminum coated ironing board covers, there is a danger of hydrogen gas build-up in the sealed drums or areas where the aluminum is mixed with water.

In recent times, there has been an acute interest in energy saving both from a labor and time saving viewpoint, as well as in terms of saving electricity. The aluminized coated ironing board covers are generally satisfactory due to their heat reflective property, but there is a need for an ironing board cover that is not only heat reflective, but heat retentive so as to save labor and electrical energy. The present invention concerns the accomplishment of these goals during the ironing and pressing of cloth articles and the like. Furthermore, the present invention does not involve the hazards of working with potentially dangerous aluminum solutions.

It is also an object of the present invention to provide a metallized fabric in which the metallized surface of the fabric substantially retains the characteristics of the fabric. That is, in known metallized fabrics, the surface characteristics are those of the overlying metal, whereas with the present invention, the texture, porosity and flexibility of the surface are substantially those of the fabric. This novel result is achieved by the manner in which the metal coating is applied to the fabric, as described more fully hereinafter. This result is significant in that it provides a metallized fabric which is heat-reflective and heat-retentive, yet substantially possesses the surface characteristics of fabric rather than of metal. This provides the texture, flexibility and porosity necessary for proper ironing. That is, the fabric surface texture provides friction which assists in holding in place the article to be ironed, while the fabric porosity enables steam and moisture to pass through the fabric to the underlying pad which permits the article to be ironed dry in fewer ironing strokes. These properties are not achieved in known metallized fabrics.

SUMMARY OF THE INVENTION

The present invention relates to a metallized fabric, in particular, a cover for an ironing board or a pressing machine. The fabric is a cotton containing fabric which is coated at least on its upper exposed surface with a coating comprising a metallic component containing at least 85 weight percent copper. In a preferred embodiment, the metallic component itself is coated with a non-metallic component such as a silicate or silicone oxide.

BRIEF DESCRIPTION OF THE DRAWINGS

For the purpose of illustrating the invention, there are shown in the drawings froms which are presently preferred; it being understood, however, that this invention is not limited to the precise arrangements and instrumentalities shown.

FIG. 1 is a perspective view of an ironing board whose ironing surface is covered with an ironing board cover in accordance with the present invention.

FIG. 2 is an exploded isometric view depicting an ironing board cover in accordance with this invention in conjunction with an ironing surface of an ironing board.

FIG. 3 is a partial sectional view taken along the line 3—3 of FIG. 1.

DETAILED DESCRIPTION OF THE INVENTION

Referring to the drawings in detail, wherein like numerals indicate like elements, there is shown in FIG. 1 an ironing board 10 having an upper ironing surface 12. Overlaying the upper ironing surface 12 is an ironing board cover 14. The ironing board cover 14 is composed of a layer of coated fabric 16 which has the general outline of a typical ironing board 10, but its edges 18 extend past the edges 20 of the ironing board surface 12.

The fabric 16 can be a woven, knitted, or non-woven fabric of cotton or blends thereof. At least the upper surface of the fabric 16 is coated with a copper containing component. The copper content of the metallic coating component is at least 85 weight percent, and is preferably at least 99 weight percent. Besides copper, the metallic component may contain zinc, tin, or both zinc and tin.

The metallic component is generally in the form of fine particles, i.e., a powder, or flakes. The micron size of the metallic particles is between about 5 microns and about 48 microns.

The metallic component particles are themselves coated with a non-metallic component such as silicates or silicone oxide. This non-metallic coating serves to insure that the ultimate coating will not tarnish from exposure to heat or the atmosphere.

The ultimate coating can be applied to the fabric material with the coating in solution form. The solvent can be aqueous or non-aqueous. A non-ionic acrylic binder is utilized with the ultimate coating. The coating can be applied to the fabric by any convenient method such as by using a knife coater, roller coater, flat bed screen printer, rotary screen printer, or unit printer.

The resultant coated fabric is porous, scorch-resistant and stain resistant, and substantially retains its fabric surface texture, flexibility and porosity. The printing process coats the fabric fibers on the fabric surface and, because of the printing pressure inherent in the printing process, coats the fibers for a region below the surface, but does not form a continuous film of metal as in known metallized fabrics. Rather, the printing process allows the fabric pores to remain open. This results in the finished fabric being porous and flexible and retaining its fabric surface texture. The resultant fabric also has a dual action property. The metallic coated surface reflects heat more efficiently than conventional ironing board covers because the natural super conductive quality of copper retains the heat that radiates into it from the heated soleplate of the iron. In the case of the purely heat reflective aluminized ironing board cover, heat is only reflected while the heated iron is positioned directly over the given contact area, and is dissipated into the atmosphere once the iron has been stroked past the given area. In the case of the combination heat retaining and heat reflective coppered ironing board cover of the present invention, heat is stored on the surface of the ironing board cover and in the coated region below the surface and is therefore generated not only when the iron is directly over the given contact area, but even when the iron has been stroked past the given area. Since repeated back-and-forth ironing strokes are required in the ironing process to drive out the dampness and the wrinkles from the article being ironed, the fact that the ironing surface in contact with the iron maintains and reflects heat means that significantly fewer ironing strokes are required. This would be somewhat analogous to a commercial pressing machine with a dual steam or electrically heated head and back.

Since another property of the copper coated ironing board cover of this invention is to distribute heat evenly, the coated fabric is substantially more scorch resistant because it is less affected by heat deterioration from hot spots.

The resultant reduction in ironing strokes by use of the ironing board cover of the present invention reduces heat exposure and abrasion on both the ironed article and the ironing board cover proper thus realizing extended life and wear in both. The higher level of ironing heat means that in the case of dry ironing, the temperature setting of the iron can be reduced lower than the previous norm. This results in a savings of electricity.

The edges 18 of the layer of fabric 16 may have binding or welting 22 through which a drawstring 24 is run. Padding 26, having generally the same shape as the layer of fabric 16, is provided. The padding 26 serves as a layer of heat resistant material juxtaposed to the lower surface of the fabric 16. Padding 26 is preferably a layer of foam polymeric material such as foam polyurethane and is approximately ¼ inch thick. The layer of padding 26 is substantially thicker than the layer of fabric 16. However, the edges of the padding 26 are coextensive with and uniformly spaced from the edges 20 of the ironing surface 12 to form the cover 14 on which the ironing is effected. The padding 26 may or may not be adhesively bound to the layer of fabric 16.

When installed on an ironing board, the padding 26 as shown in FIG. 2 is coextensive with the edges 20 of the ironing surface 12. A marginal skirt 28 can be turned down and under the ironing surface 12. As seen in FIG. 3, when drawstring 24 is tightened, welting 22 is snugly held on the undersurface of the ironing surface 12.

The present invention is further described by reference to the following specific, non-limiting example.

EXAMPLE

A natural loom-state greige cotton fabric was coated with an aqueous solution of "ETERNA COPPER #120" powder produced by Atlantic Powdered Metals, Inc. of New York, N.Y. and "METALLIC BINDER 113" of Polymer Industries of Greenville, S.C. The properties of the "ETERNA COPPER #120" powder utilized were as follows:

Purity: 99% copper with trace amounts of zinc and/or tin
Particle size: 33 to 44 microns
Heat stability: 300° C. to 320° C.
Screen analysis: 98% through 200 mesh
Specific gravity: 88

The properties of the binder utilized were as follows:

Appearance: white viscous emulsion
pH: 6.0±0.5
Viscosity: 6 to 8,000 cps
Boiling point: Approximately 212° F.
Specific gravity: 1.04

The copper powder was coated with silicate prior to introduction into the solution to impede discoloration.

The formulation employed for the coating was as follows:

"METALLIC BINDER 113" (X354-13) binder—95 lbs
"ETERNA COPPER #120" powder—12 lbs
"SPECTRACHEM THICKENER NO. W6948B"—3 pints
Water—105 lbs Water and thickner were first homogenized together. The binder was then added and the resultant mixture was then homogenized. The copper powder was then introduced into the mixture and once again the resultant mixture was homogenized.

The coating was applied to the fabric by use of a rotary screen printer. After coating, the web was dried in a multi-pass dryer at approximately 325° F. to 350° F.

The present invention may be embodied in other specific forms without departing from the spirit or essential attributes thereof and, accordingly, reference should be made to the appended claims, rather than to the foregoing specification, as indicating the scope of the invention.

I claim:

1. An ironing board cover, comprising:

(a) a porous fabric having an upper, exposed surface, (b) the fibers of said fabric on said surface and for at least a region below and bounded by said surface being coated by a composition pressure-printed thereon, said composition comprising a metallic component, said coating being porous and permitting said surface to substantially retain its fabric texture, flexibility and porosity while being heat reflective, and wherein such region is heat retentive, (c) said metallic component having at least 85 weight percent copper.

2. A cover in accordance with claim 1 wherein said metallic component comprises at least 99 weight percent copper.

3. A cover in accordance with claim 1 wherein said fabric is a woven fabric.

4. A cover in accordance with claim 1 wherein said metallic component further comprises zinc.

5. A cover in accordance with claim 1 wherein said metallic component further comprises tin.

6. A cover in accordance with claim 1 wherein said fabric includes cotton.

7. A cover in accordance with claim 1 which further comprises a layer of heat resistant padding disposed beneath said fabric, said padding being substantially thicker than said fabric.

8. A cover in accordance with claim 1 wherein the coating further comprises a binder and a thickener.

9. A cover for an ironing board or pressing machine which comprises a porous fabric coated on its upper exposed surface and for a region below and bounded by said surface by pressure-printing thereon a heat-reflective and heat-retentive porous coating comprising a metallic component having at least 85 weight percent copper, the metallic component being in the form of particles having an average particle size of between approximately 5 microns and approximately 48 microns.

10. A cover in accordance with claim 9 wherein said particles are coated with a non-metallic component.

11. A cover in accordance with claim 10 wherein said non-metallic component is selected from the group consisting of silicates and silicon oxide.

12. A cover in accordance with claim 9 wherein said fabric is a non-woven fabric.

13. A cover in accordance with claim 9 wherein said fabric is a knitted fabric.

14. A cover for an ironing board comprising a fabric coated on its upper surface and for a region below and bounded by said surface by pressure-printing thereon a composition comprising particles which are about 85 to about 99 weight percent copper, said particles having an average size of between about 5 microns and 48 microns, said particles being coated with a component selected from the group consisting of silicates and silicon oxide, and a layer of heat resistant material juxtaposed to the lower surface of said fabric.

15. A metallized fabric, said fabric being porous and having an upper, exposed surface, the fibers of said fabric on said surface and for at least a region below and bounded by said surface being coated by a composition pressure-printed thereon, said composition comprising a metallic component, said coating being porous and permitting said surface to substantially retain its fabric texture, flexibility and porosity while being heat reflective, and wherein said region is heat retentive, said metallic component having at least 85 weight percent copper.

* * * * *